US005524467A

United States Patent [19]

Wetzels

[11] Patent Number: 5,524,467

[45] Date of Patent: Jun. 11, 1996

[54] METHOD FOR THE INNER PROFILING OF TUBES OR PIPES

[75] Inventor: Walter Wetzels, Aachen, Germany

[73] Assignee: Schumag Aktiengesellschaft, Aachen, Germany

[21] Appl. No.: 276,052

[22] Filed: Jul. 14, 1994

[30] Foreign Application Priority Data

Jul. 16, 1993 [DE] Germany ..... 43 23 840.8

[51] Int. Cl.[6] ..... B21B 19/12

[52] U.S. Cl. ..... 72/78; 72/96

[58] Field of Search ..... 72/68, 77, 78, 72/96

[56] References Cited

U.S. PATENT DOCUMENTS 4,373,366 2/1983 Tatsumi ..... 72/78

4,864,836 9/1989 Ochiai ..... 72/247

FOREIGN PATENT DOCUMENTS 112911 7/1982 Japan ..... 72/78

3-169421 7/1991 Japan .

*Primary Examiner*—Lowell A. Larson

*Attorney, Agent, or Firm*—W. G. Fasse; W. F. Fasse

[57] ABSTRACT

The invention relates to a method for the better utilization of the working width of a profiling stone in the inner profiling of heat exchanger pipes. The press on width of the revolving roller bodies is substantially narrower than the profile width of the profiling stone so that in this area the profiling stone is worn out rapidly while the other area remains unworn since it is not utilized. In order to avoid this, the invention suggests that the press on rollers and the profiling stone is moved within the range of the working width of the profiling stone axially back and forth so that the entire profile range of the profiling stone can be utilized.

7 Claims, 5 Drawing Sheets

METHOD FOR THE INNER PROFILING OF TUBES OR PIPES

FIELD OF THE INVENTION

The invention relates to a method for the inner profiling of pipes or tubes with a profiling stone arranged coaxially inside the pipe or tube.

BACKGROUND INFORMATION

A profiling stone for the above purpose has a cylindrical jacket surface facing, in the working position, the inner pipe surface, whereby the surface enclosed by the jacket surface comprises outer surface profiling suitable for the production of the inner pipe profiling. A plurality of roller bodies are arranged around the circumference of the pipe. The roller bodies press the pipe within a working range against the surface profiling of the profiling stone. For this purpose the roller bodies perform a revolving motion around the pipe while the pipe is being moved axially at the same time.

An apparatus for performing such a method is equipped with a draw nozzle and a drawing device for transporting the pipe in a drawing direction, whereby a drawing mandrel is provided for cooperation with the draw nozzle. The drawing mandrel is arranged coaxially and comprises a supporting mandrel. A profiling stone is arranged at the free end of the supporting mandrel. The apparatus further includes a roller head with roller bodies each of which is mounted for rotation about its own axis and all are mounted for rotation about an axis coaxial with the pipe to be worked.

A method and apparatus of the type mentioned above have become known through Japanese Patent Application No. 64-312046 published under No. 3-169421 (A). Such a method and the respective apparatus for performing the method have been found to be quite reliable. The substantially cylindrical profiling stones inside the pipe to be profiled perform their function satisfactorily. However, the production of such stones is quite expensive. For performing the method, the outer revolving roller bodies must make a pipe smaller, whereby the pipe is internally somewhat larger than the diameter of the profiling stone. For this purpose the rollers press the pipe against the profile of the profiling stone. This pressing takes place in a zone that is relatively short in the axial direction. This zone is substantially smaller than the length of the profiling stone. As a result, the press-on forces can be maintained relatively small, whereby simultaneously the specific forces can be sufficiently large. However, this feature has the consequence that in the relatively small working range of the roller bodies the profile of the profiling stone is rather quickly worn out so that the expensive profiling stone must soon be exchanged, although only a portion of its entire profile is worn out while the rest of the profile is still as good as new.

OBJECT OF THE INVENTION

Starting from the above situation it is the object of the invention to suggest a method of the type described above with which it is possible to better utilize the profiling stone.

SUMMARY OF THE INVENTION

Starting from a method as described above, the above object is achieved according to the invention in that during the motion of the roller bodies and of the pipes, the profiling stone and the roller bodies are caused to periodically and axially oscillate relative to each other back and forth, whereby the working range of the rollers does not leave the range of the surface profile of the profiling stone. In this manner it is possible to displace the working range, which as such is desirably small, back and forth on the profiling stone so that the entire profile of the stone can be completely utilized. Simultaneously, it is possible to retain the relatively small press-on forces with respective large specific forces. The relative motion may be accomplished by a respective relative motion among all coordinated structural components as well as by a respective axial motion of only the rollers or only the profiling stone while the respective other component remains stationary relative to the outer surroundings.

According to a further embodiment of the present method it is suggested that the relative velocity between the profiling stone and the roller bodies in the direction opposite to the axial motion direction of the pipe, is equal to, smaller than, or faster than in the axial motion direction of the pipe. Hereby, it is possible to achieve an adaptation to the qualities of the material being worked and to optimize the working speed.

A further embodiment of the invention provides that the axial relative motion between the profiling stone and the roller bodies is produced by a respective axial motion of the roller bodies while the profiling stone retains its position relative to the surroundings. An alternative to this version provides that the axial relative motion between the profiling stone and the roller bodies is produced by a respective axial movement of the profiling stone while the roller bodies retain their position relative to the surroundings. Both possibilities and a combination of these two possibilities make it possible to completely utilize the profile of the profiling stone.

The method of the invention can be performed by an apparatus wherein a roller head with the roller bodies or the roller head and/or the drawing head with the draw nozzle or the draw nozzle are power operated with the desired stroke to provide the required relative movement in the axial direction. These components are constructed for an axial back and forth movement with the desired velocity, whereby the profiling stone is arranged rotatably and fixed against axial movement in both directions on the support mandrel. Thus, in substance, the known structural components of such machines may be retained and it is merely required that, for example, that the roller head or the drawing head is made axially movable with a suitable slide provided with a suitable power drive. Such power drive can be a hydraulic cylinder or a simple spindle drive whereby the size of the motion and the motion velocity can be monitored respectively by known structural components such as displacement sensors or selsyn devices. Since conventional displacement drives for machine slides which include a displacement control and a velocity control, and which are connected with a suitable machine control, are known, it is not necessary to dwell on further details.

In order to achieve the desired relative motion in the axial direction it is not absolutely necessary that the entire roller head or the entire drawing head with the respective coordinated roller bodies or with the respective coordinated draw nozzle are being moved. Rather, it is sufficient that the roller body alone or the draw nozzle alone is being moved. This is possible when the mentioned structural components are mounted for axial displacement. For this purpose the draw nozzle can, for example, be constructed to include a ring piston and activated through the ring piston.

A modified apparatus suitable for the present purpose has a roller body supported hydrostatically, whereby the diameters of the roller bodies can be kept small while using a rigid support and nevertheless a smoothly working bearing is achieved without the provision of special bearing elements such as roller bearings. Since the roller bodies and the entire roller head rotate very rapidly, for example at 15,000 r.p.m., a bearing support by means of roller bearings would be problematic.

Preferably, the roller bodies are constructed for adjustment in their radial position within a provided working range. This feature permits a precise adaptation to the desired roller dimensions.

BRIEF DESCRIPTION OF THE DRAWINGS

The invention shall now be described in more detail with reference to the accompanying drawings which show an example embodiment.

DETAILED DESCRIPTION OF PREFERRED EXAMPLE EMBODIMENTS AND OF THE BEST MODE OF THE INVENTION

Figure 5:
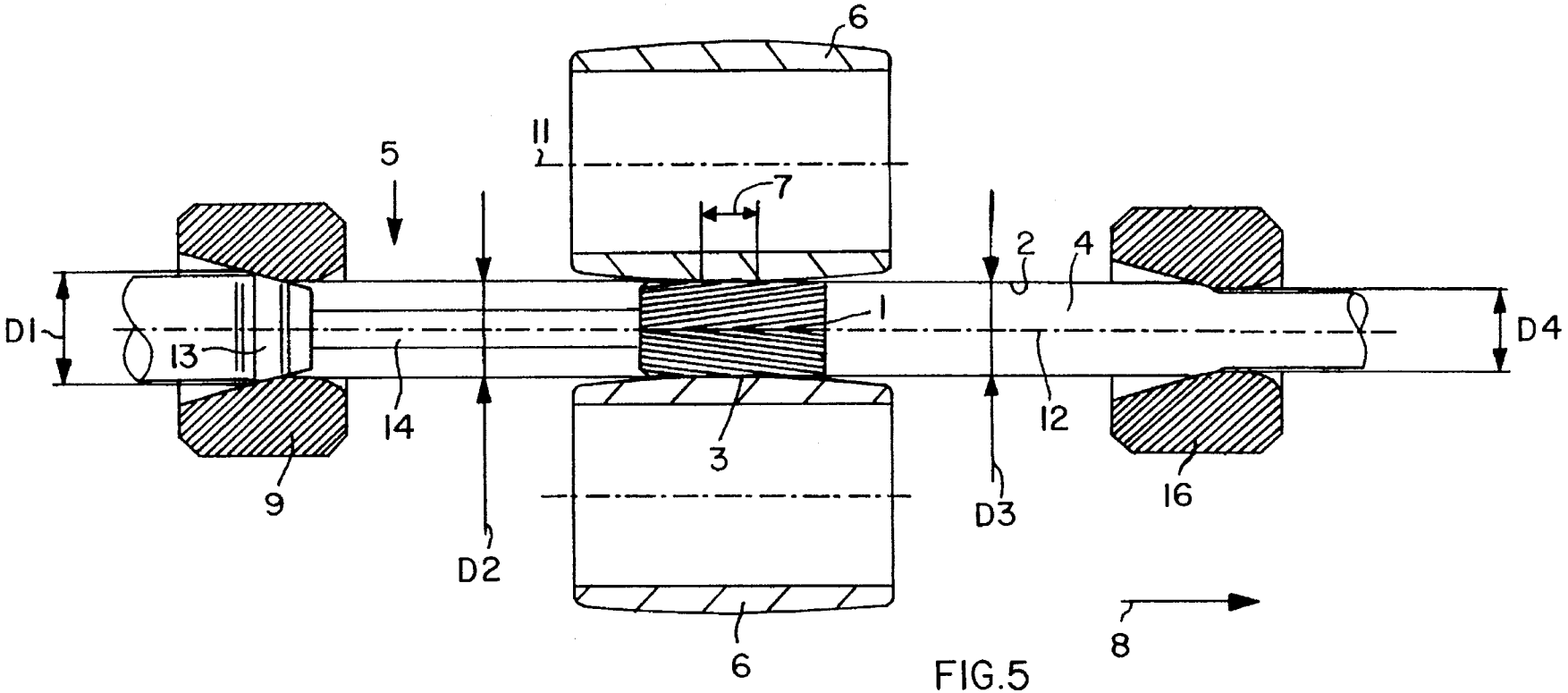
FIG. 5 shows an arrangement as in FIG. 4, however with a simplified illustration.

FIG. 5 shows a simple view of a basic tool arrangement for performing the method according to the invention. According to FIG. 5 the pipe 5 shall be provided with an inner profile which is, for example, desirable for copper pipes of heat exchanger devices. For this purpose the outer diameter D1 of the pipe 5 is reduced to the outer diameter D2 in a draw nozzle 9 which is part of a known drawing apparatus not shown in FIG. 5. Hereby, the wall thickness may simultaneously be reduced and for this purpose a drawing mandrel 13 arranged at the draw nozzle 9 is used as is customary. This arrangement is known and thus needs no further explanation.

The drawing mandrel 13 comprises a support mandrel 14 arranged coaxially to the drawing mandrel 13 and also coaxially to the pipe 5. A profiling stone 1 is rotatably arranged at the free end of the support mandrel 14. Roller bodies 6 are arranged in the area of the profiling stone 1 on the circumference 4 of the pipe 5. The roller bodies 6 are rotatably mounted for rotation about an axis 12 common to the mentioned structural components and each roller body is also mounted for rotation about its own axis 11. The roller bodies 6 have a working range 7 within which the roller bodies rest against the outer circumference 4 of the pipe 5. The roller bodies 6 compress the pipe wall within this working range 7 against the profile 3 of the profiling stone 1 so that a respective profile is impressed on the inner pipe wall 2, said inner pipe profile corresponding to that of the profiling stone 1. Thus, the pipe diameter D2 is reduced to the pipe diameter D3 between the roller bodies 6. After this profiling operation the pipe 5 is drawn through a calibration nozzle 16 to thereby reduce the pipe diameter to the diameter D4. During such working of the pipe 5 it performs an axial motion 8 due to the drawing operation while the roller bodies 6 simultaneously revolve very rapidly around the pipe.

Figure 4:
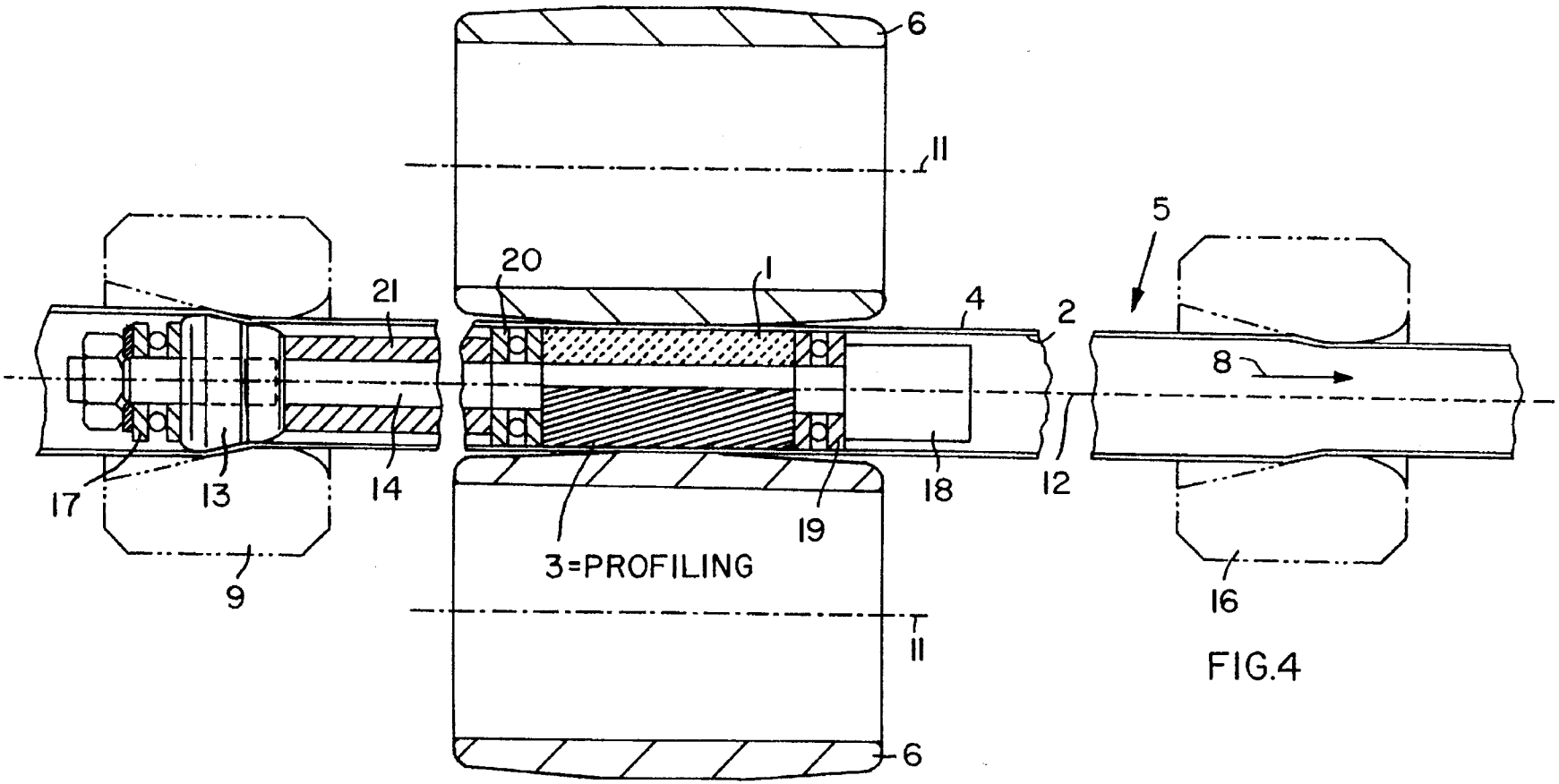
FIG. 4 shows a schematic arrangement of the required tools.

FIG. 4 shows the same basic construction as FIG. 5. However, in FIG. 4 the arrangement and support of the profiling stone 1 is shown in more detail. The support mandrel 14 is rotatably mounted inside the drawing mandrel 13 and axially supported by an axial bearing 17 in the direction of the axial movement 8. The free end of the support mandrel 14 has a stop 18 against which an axial bearing 19 is supported. The profiling stone 1 is rotatably mounted on the support mandrel 14 and bears against this axial bearing. The support mandrel 14 also bears at its second facing side against an axial bearing 20 which on its part bears with its further plane surface against a spacer bushing 21. The spacer bushing 21 bears with its second facing side against the drawing mandrel 13 so that the profiling stone 1 is held with a determined and desired spacing from the drawing mandrel 13 axially fixed and rotatable on the support mandrel 14.

Figure 1:
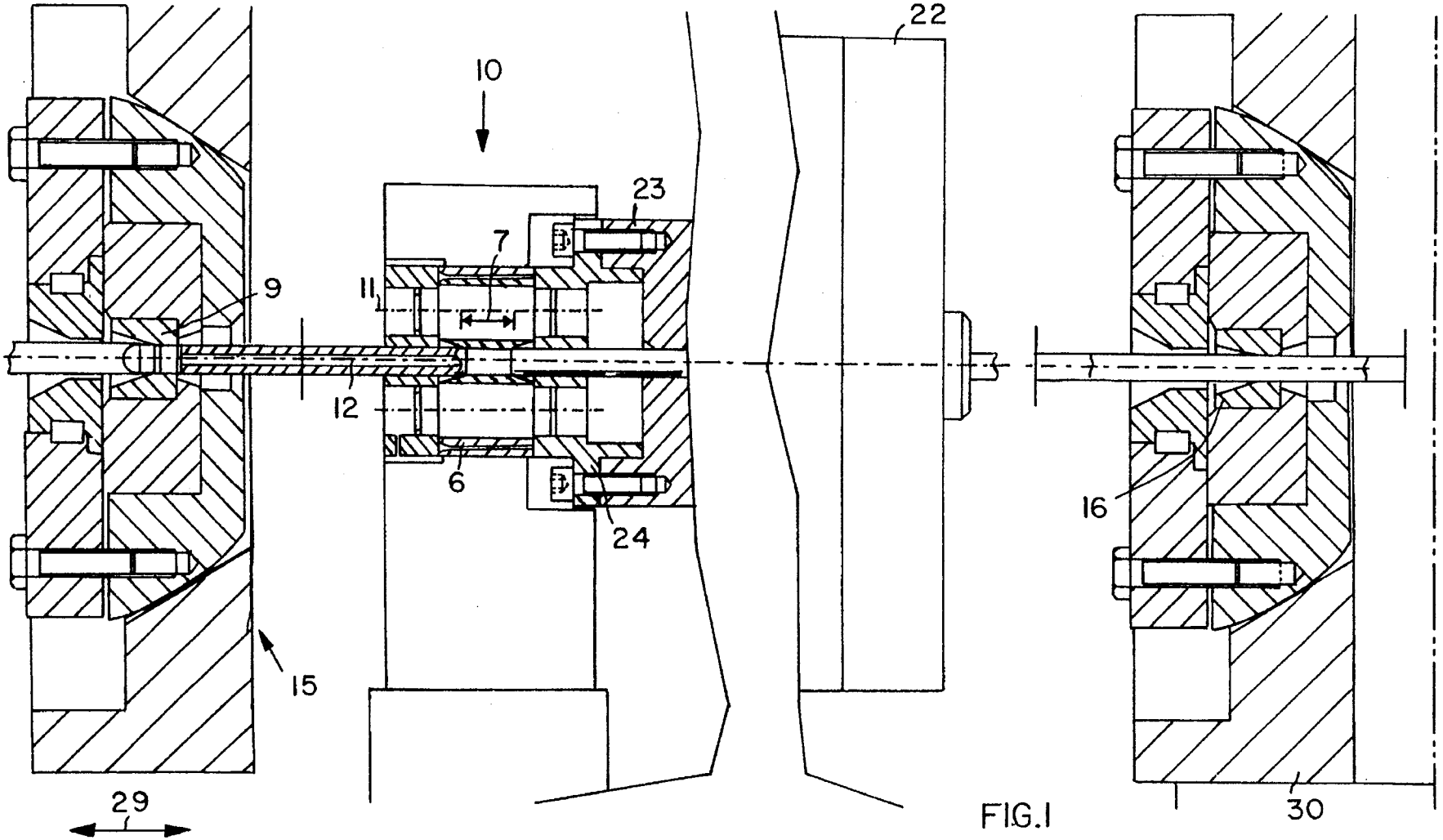
FIG. 1 shows in section a roller head with a draw nozzle arranged in front of the roller head and with a calibration draw nozzle arranged back of the roller head in section.
Figure 2:
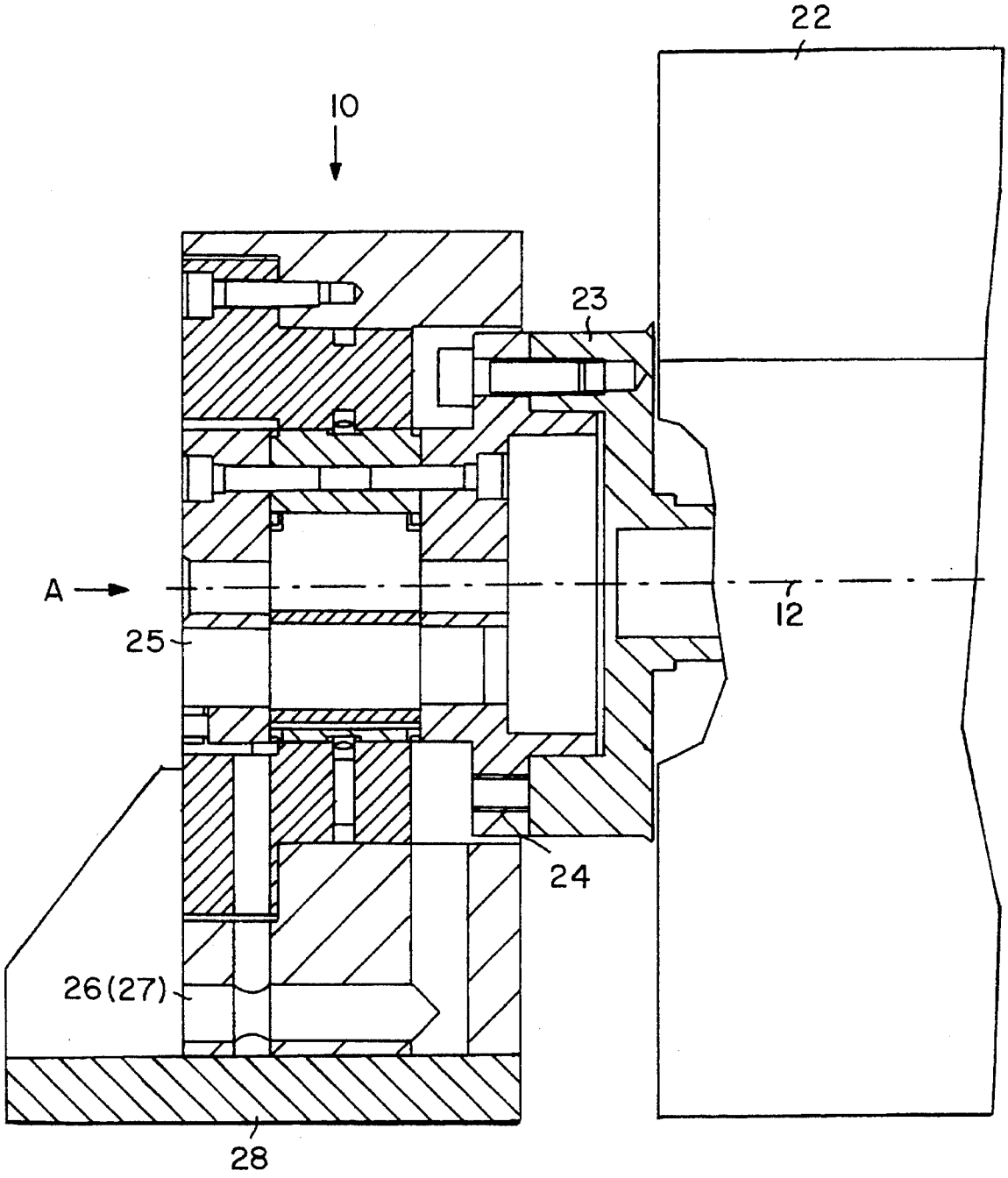
FIG. 2 shows a section through the roller head of FIG. 1.
Figure 3:
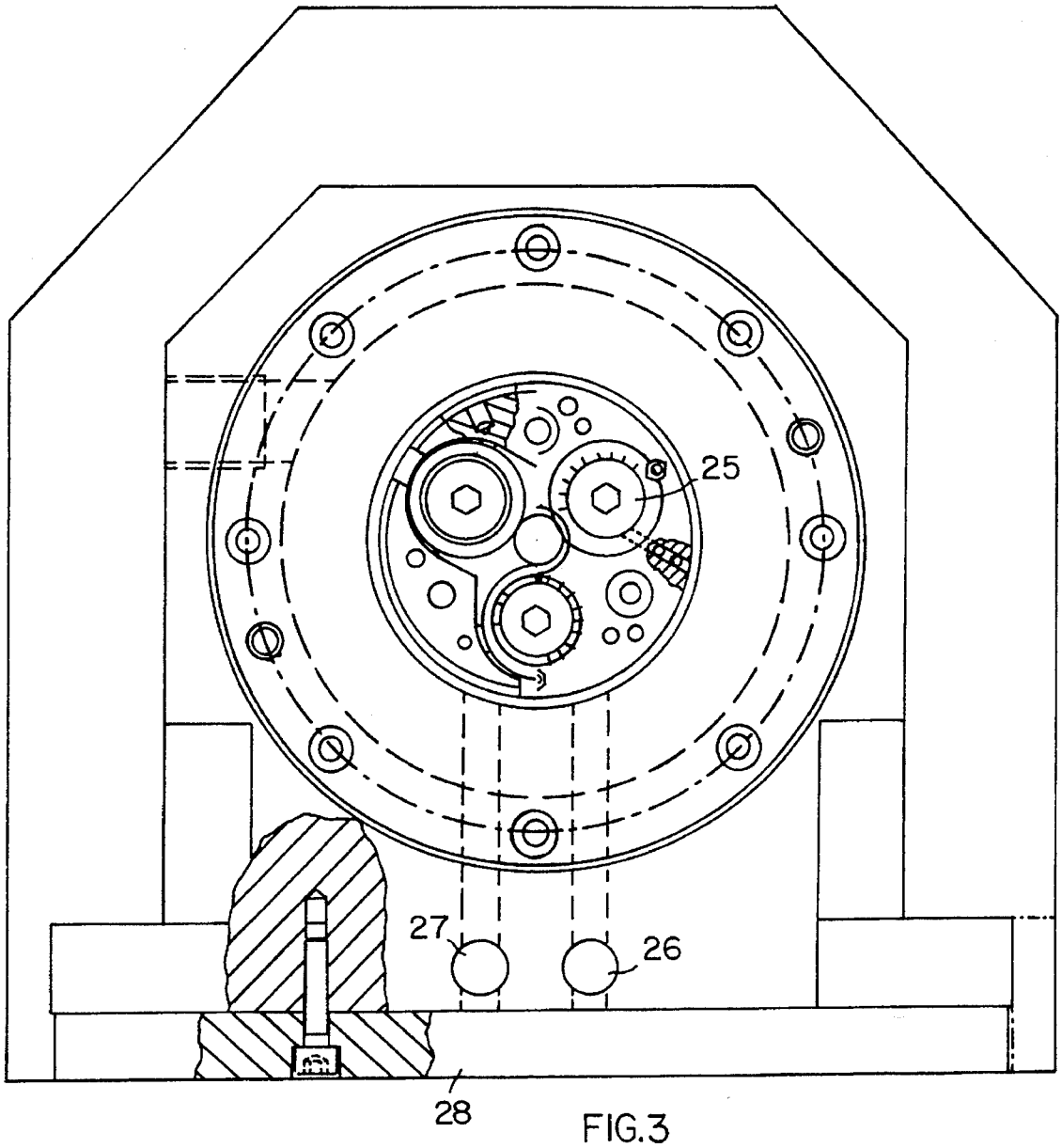
FIG. 3 is a view in the direction of the arrow A in FIG. 2.

FIG. 2 shows the roller head 10 in section while FIG. 3 shows a facing view according to arrow A in FIG. 2. The arrangement of the roller head in the entire system is shown in FIG. 1. A suitable construction for the hydrostatic bearing of the roller bodies 6 and their arrangement in a head that itself is rotatably mounted, may substantially be left to the person of ordinary skill in this art. Thus, only the critical structural components of an example embodiment according to FIGS. 2 and 3 will be explained.

A spindle head 22 is arranged on a machine bed not shown in detail. The spindle head 22 supports a rotatably mounted spindle 23 which is connected with a rotational carrier 24 which is also rotatably mounted in the roller head 10 and which is assembled of several individual components. The bearing axles 25 of the roller bodies 6 are arranged in the rotational carrier 24 distributed around the circumference. In the example embodiment three bearing axles 25 are provided. The fluid required for the hydrostatic bearing support of the roller bodies 6 is supplied to the bearing axles 25 with the required pressure through the oil supply lines 26 and 27. Such hydrostatic bearings and the fluid supply and withdrawal required for these bearings are known in the art so that no further explanations are necessary in this respect.

The free ends of the bearing axles 25 are arranged somewhat eccentrically relative to the bearing range of the roller bodies 6 to provide for a radial adjustment so that a rotation of the bearing axles 25 causes a radial positional displacement of the roller bodies 6. After the required rotational adjustment a clamping constructed in any desired way can then fix the bearing axles 25 in their adjusted position.

The entire roller head 10 may be mounted on a support 28 which in turn is secured in a machine bed not shown or which is, for example, mounted together with the spindle head 22 on a slide that is movable back and forth, but is not shown. Thus, the mounting of the roller head 10 is possible either in a fixed position or as a movable mounting. With a respective radial adjustment of the roller bodies 6 these roller bodies press the pipe 5 as described against the outer profiling of the profiling stone 1 so that a respective counterprofiling on the inner pipe wall 2 is produced. For this purpose the roller bodies 6 driven by the spindle 23 and the rotatable carrier 24 connected therewith revolve very rapidly around the pipe while the pipe is being axially moved in an axial motion direction 8 corresponding to the drawing direction.

As far as roller head 10 and spindle head 22 are arranged for axial movement on a slide, these components may be moved back and forth with the desired stroke and with the required speed, whereby also the roller bodies 6 are moved correspondingly back and forth. As a result the roller bodies in their working range 7 can travel along the entire profile range of the profiling stone 1 which in this embodiment is locally fixed so that the entire profile of the profiling stone may effectively be used.

Another possibility of utilizing the entire profile of the profiling stone resides in that the roller head 10, for example, is left stationary and instead the profiling stone is axially moved back and forth inside the pipe 5. This can simply be achieved in that during the drawing operation the draw nozzle 9 is correspondingly moved axially back and forth, whereby the drawing mandrel 13 and thus, through the support mandrel 14, the profiling stone 1 is moved correspondingly back and forth. In order to achieve this, the draw nozzle 9 may alone be moved back and forth inside the draw head 15, for example in the form of a ring piston. Alternatively, as shown in the example embodiment in FIG. 1, the draw nozzle can be moved back and forth by means of the entire drawing head 15. The drawing head 15 is thereby constructed in a conventional manner so that its construction does not need to be described in detail. Rather, the draw head 15 is sufficiently shown in FIG. 1 with its construction that is known as such. However, in this last embodiment it is necessary to arrange the drawing head 15 on a respective slide in order to produce the required axial motion which is shown in FIG. 1 by the arrow 29. Since the drives for the back and forth motion of the slides are of conventional constructions they need not be described in further detail. The construction of such slide drives is not part of the invention.

A calibration head 30 having a calibration nozzle 16 is provided on the roller head 10 on its side opposite the drawing head 15 as viewed in the drawing direction. The calibration head 30 reduces the diameter of the pipe 5 after the profiling operation to the desired diameter D4, see FIG. 5. The construction of the calibration head 30 is known as such so that it does not need to be described in further detail.

Although the invention has been described with reference to specific example embodiments, it will be appreciated that it is intended to cover all modifications and equivalents within the scope of the appended claims.

I claim:

1. A method for the inner profiling of pipes (5) with a profiling stone (1) arranged coaxially inside a pipe, said profiling stone having a cylindrical jacket surface facing, in the working position of said profiling stone (1), an inner pipe surface, wherein the jacket surface comprises a surface profile (3) suitable for the production of said inner profiling inside a pipe, and whereby a plurality of roller bodies (6) are arranged on the outer circumference (4) of a pipe (5) for pressing a pipe (5) within a working range (7) against the surface profile (3) of said profiling stone (1), said roller bodies performing a revolving motion around a pipe (5) which is simultaneously being moved axially, comprising the following steps:

(a) rotating said profiling stone (1) inside a pipe to be profiled about a longitudinal axis (12) extending in a feed advance direction of said pipe, (b) simultaneously revolving said roller bodies (6) about said longitudinal axis (12) while permitting each of said roller bodies to rotate about its individual roller body axis (11), (c) imparting to at least one of said profiling stone (1) and said roller bodies (6) a periodic oscillating motion back and forth in said feed advance direction to provide a relative axial displacement in said feed advance direction between said profiling stone (1) and said roller bodies (6), and (d) limiting said relative axial displacement so that a working range (7) of said roller bodies (6) remains within said surface profile (3) of said profiling stone (1).

2. The method of claim 1, wherein said imparting step is performed by axially oscillating said roller bodies (6) back and forth in said feed advance direction of said pipe, while keeping said profiling stone (1) axially fixed.

3. The method of claim 1, wherein said imparting step is performed by axially oscillating said profiling stone (1) back and forth in said feed advance direction of said pipe, while keeping said roller bodies (6) axially fixed.

4. The method of claim 1, wherein said imparting step is performed by axially oscillating said roller bodies (6) and said profiling stone (1) back and forth in said feed advance direction of said pipe.

5. The method of claim 1, further comprising selecting a relative velocity for said relative axial displacement in a direction opposite to said feed advance direction, so that said relative velocity in said opposite direction is equal to, or slower than, or faster than a respective velocity in said feed advance direction of said pipe.

6. The method of claim 1, further comprising supporting said roller bodies hydrostatically.

7. The method of claim 1, further comprising radially adjusting said roller bodies in a direction extending radially to said longitudinal axis (12) within said working range (7) of said roller bodies.

* * * * *